US005222777A

United States Patent [19]

Clonch

[11] Patent Number: 5,222,777

[45] Date of Patent: Jun. 29, 1993

[54] APPARATUS AND METHOD FOR PICKING UP AND REMOVING OBJECTS

[76] Inventor: Danny G. Clonch, 807 White River Dr., Orlando, Fla. 32828

[21] Appl. No.: 921,071

[22] Filed: Jul. 29, 1992

[51] Int. Cl.[5] ..... A01K 29/00; E01H 1/12

[52] U.S. Cl. ..... 294/1.3; 294/25

[58] Field of Search ..... 294/1.3-1.5, 294/25, 55; 2/20, 159, 164; 15/104.8, 227, 257.1, 257.6, 257.9; 229/DIG. 3; 383/4, 72, 73

[56] References Cited

U.S. PATENT DOCUMENTS

| | | | |
|---|---|---|---|
| 3,971,503 | 7/1976 | Allan et al. | 294/1.3 |
| 4,132,442 | 1/1979 | Larsson | 294/1.3 |
| 4,215,886 | 8/1980 | Naderi et al. | 294/1.3 |
| 4,494,785 | 1/1985 | Song | 294/25 X |
| 4,515,841 | 5/1985 | Dyke | 428/35 |
| 4,645,251 | 2/1987 | Jacobs | 294/1.3 |
| 4,677,697 | 7/1987 | Hayes | 2/159 |
| 4,741,565 | 5/1988 | Bagg | 294/1.3 |
| 4,747,633 | 5/1988 | Stacy | 294/1.3 |
| 4,768,818 | 9/1988 | Kolic | 294/1.3 |
| 4,788,733 | 12/1988 | Lerner | 294/1.3 X |
| 4,854,624 | 8/1989 | Baymiller | 294/1.3 |
| 4,902,283 | 2/1990 | Rojko et al. | 294/1.3 X |
| 5,149,159 | 9/1992 | Bardes | 294/1.3 |

FOREIGN PATENT DOCUMENTS

| | | | |
|---|---|---|---|
| 2587876 | 4/1987 | France | 294/1.3 |
| 661077 | 6/1987 | Switzerland | 294/1.3 |
| 2208588 | 4/1989 | United Kingdom | 294/1.3 |
| 2237973 | 5/1991 | United Kingdom | 294/1.3 |

*Primary Examiner*—Johnny D. Cherry

*Attorney, Agent, or Firm*—Steven C. Stewart; William M. Hobby, III

[57] ABSTRACT

An apparatus for picking up or removing objects and the like, expressly animal excrement, comprising a receiver portion formed of a relatively rigid material having an accordion portion that collapses and expands. The accordion portion is partially enclosed in a sheath. The sheath has an open end in which the hand of the operator can be inserted to engage the reinforcement portion through the sheath. The objects are then picked up and the reinforcement portion is then folded inside out and closed. The accordion portion acts as a barrier between the object and the sheath to prevent leakage or the object from perforating the sheath.

15 Claims, 1 Drawing Sheet

APPARATUS AND METHOD FOR PICKING UP AND REMOVING OBJECTS

BACKGROUND OF THE INVENTION

The present invention relates to a new and improved apparatus and method for picking up and removing objects, and specifically, although not inclusively, picking up and removing animal excrements.

In the context of this disclosure, and while the invention has particular utility with respect to the removal of animal excrements, it should be understood that the term "objects" is used in broader sense as referring to any contamination or waste and is not simply specific to the removal of such type substances or "objects", as the disclosure will clearly suggest other possible uses of the apparatus.

It has been frequently observed that animals, expressly domestic pets, including dogs, tend to deposit their feces or excrements at locations which are particularly annoying to humans. Oftentimes, deposits occur at parking garages, areas in front of or in houses and other buildings, parks, trails, sidewalks and other paths used by pedestrians or hikers. Up to the present, the removal of such feces or excrements has been associated with considerable difficulties and, in instances where there was not available a suitable removal device, such feces removal was not possible.

Similar waste disposal problems can arise in hospitals, nursing homes, kitchens and the like, where oftentimes waste material, such as for instance, cotton, glass, needles and other contaminated objects or articles are to be removed.

One such removal device is disclosed in U.S. Pat. No. 4,132,442 to Larson. This device has a receiver portion formed of relatively rigid material and is intended to be engaged by an operator for reception of the object to be picked up. The device includes a plastic bag having a receiver portion at one end through which objects are deposited and rest on the bag. The bag can forwardly be turned over and if desired closed. However, when sharpened objects or heavy objects are picked up and placed in the plastic bag, these objects can create cuts or openings. Objects piercing through these openings can cause injury to the operator when carried. Further, the object can leak from the bag again recreating the disposal problem.

Other devices have been used to pick up objects, however, these devices are typically complicated to construct and require a large number of expensive and time consuming processing steps.

SUMMARY OF THE INVENTION

Hence, with the foregoing in mind as primary, an object of the present invention to provide a new and improved construction of an apparatus, and method for picking up and removing various type articles or the like, expressly with the view of solving the aforementioned waste removal problems.

It is a further object of the invention to construct a new and improved apparatus for picking up various types of objects or substances such as animal excrements, but not limited thereby, and such items as contaminated in hospitals, such as cotton, glass and so forth, which is relatively simple in construction and design, economical to manufacture and use.

It is a further object of the invention to provide an apparatus for seizing and removing articles in a simple manner which prevents inadvertent leakage and openings of the apparatus when sharp or heavy objects are picked up.

In a preferred aspect of the invention, a method for picking up and removing objects is provided. The method includes the steps of providing a container having an opening at one end and being sealed at its other end. A fold line is positioned circumferentially subscribing the container adjacent the sealed end. The sealed end is folded back into the container about the fold line to create a receiving portion having a ceiling and a floor. A reinforcement device is provided having a top portion, an opposingly facing bottom portion, and an accordion portion extending substantially perpendicular to the top and bottom portion between the top and bottom portion. The reinforcement device is placed within the receiving portion by attaching a portion of the top portion to the ceiling and a portion of the bottom portion to the floor. The accordion portion is positioned adjacent the sealed end when the top and bottom portions are attached to create a second receiving portion. A hand of an operator is placed into the open end of the container to engage the top and bottom portions of the reinforcement device. The engaged top and bottom portions are manipulated to pick up the object and place the object in the second receiving portion.

In another aspect of the invention, an apparatus for picking up and removing objects are provided. The apparatus includes a generally C-shaped reinforcement device constructed from a substantially stiff material being defined by a top portion, a bottom portion and a flexible portion extending generally perpendicular therebetween. The reinforcement device has an opening in which objects can be received. A sheath surrounds the reinforcement device and has an open end into which the hand of the operator can be inserted to engage the reinforcement device. The sheath is attached to the reinforcement device to form a pocket between the sheath and the top portion, and is attached to form another pocket between the sheath and the bottom portion. When the hand of the operator is inserted into the open end to engage the reinforcement device, the fingers of the hand can be inserted in the pocket to manipulate the apparatus for picking up objects. Preferably, the sheath has a sealed closed end on the other end of the sheath from the open end. The sealed end is preferably folded into the sheath to form a receiving portion in which picked up objects are placed. The C-shaped reinforcement device is positioned in the receiving portion with the opening facing away from the sheath. In this manner the reinforcement device provides a barrier between the object and the sheath, such that when the sheath is constructed from plastic, sharp materials are prevented from penetrating the plastic, contacting the user, and leaking.

BRIEF DESCRIPTION OF THE DRAWINGS

The invention will be better understood in objects other than those set forth above, will become apparent when consideration is given to the following detailed description thereof. Such descriptions make reference to the annexed drawings wherein.

DESCRIPTION OF THE PREFERRED EMBODIMENTS

Figure 1:
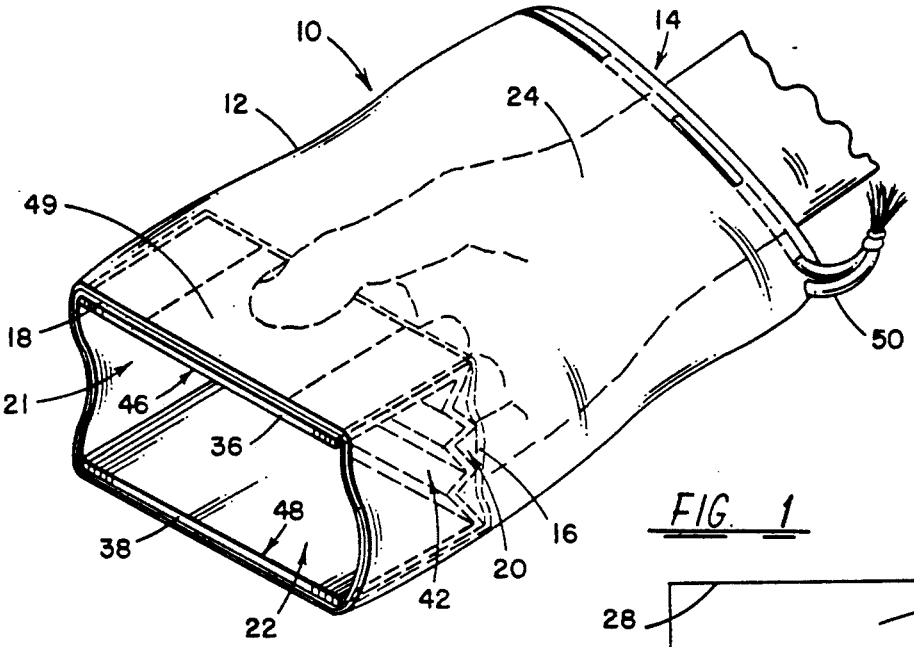
FIG. 1 is a perspective view of a waste disposal apparatus constructed according to the present invention having a sheath and a reinforcement portion.

Describing now the drawings, and as disclosed specifically in FIGS. 1–6, the exemplary embodiment of waste disposal apparatus depicted therein and designated generally by 10, is especially suitable, for instance, for the hygienic removal and packaging of relatively solid animal excrements, such as, for instance, the feces of dogs. The apparatus comprises a sheath 12 having an open end 14 and a sealed end 16. Sealed end 16 is folded inwardly into sheath 12 about fold line 18 circumferentially subscribing sheath 12 adjacent the sealed end to form a receiving portion 20. A reinforcement device 22 is placed in receiving portion 20 to create a second receiving portion 21. A hand 24 is fed through open end 14 to engage reinforcement device 22 to manipulate apparatus 10 to pick up objects 26 (FIG. 4) and place these objects 26 in the second receiving portion 21.

Figure 3:
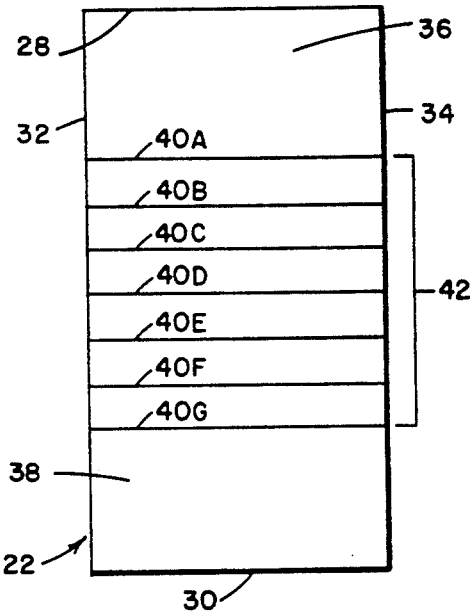
FIG. 3 is a plan view of a blank used to construct the reinforcement portion shown in FIG. 1.

Referring to FIGS. 1 and 3, reinforcement device 22 is preferably constructed from a stiff material such as cardboard and is generally rectangular. However, reinforcement portion 22 may be shaped in any of a variety of different geometric patterns including oval, square, circular, octangular, etc. or oblong, and it is by no means limited to a rectangular shape. Reinforcement portion 22 has a top edge 28, a bottom edge 30, a left side 32, and a right side 34. Disposed adjacent top edge 28 between left side 32 and right side 34 is a top portion 36. Disposed adjacent bottom edge 30 between left side 32 and right side 34, is bottom portion 38. A plurality of parallel score lines 40A–40G are alternately placed on opposite sides of reinforcement portion 22. Specifically, score lines 40A, 40C, 40E and 40G are placed on the top surface of reinforcement portion 22 and the alternate score lines 40B, 40D, and 40F are placed on the bottom surface of portion 22. Alternating score lines 40A, 40C, 40E, and 40G, are folded in the same direction, while adjacent score lines 40A,40B,40C, . . . etc. are folded in opposite directions. When folded, reinforcement portion 22 forms a top portion 36 extending parallel to a bottom portion 38, and accordion portion 42 extending perpendicular between top portion 36 and bottom portion 38. Although seven folds are preferable, the invention is not limited to seven folds. The area between score lines 40A and 40G are referred to as flexible or accordion portion 42.

When sheath 12 is folded about fold line 18, receiving portion 20 is formed having a ceiling 46 and a floor 48. Top portion 36 is attached to ceiling 46 preferably using a conventional heat melting process. Bottom portion 48 is attached to floor 48 using a similar process. Although the preferred process is heat melting to attach sheath 12 to reinforcement portion 22, other methods are equally applicable such as epoxy, glue or stapling.

When sheath 12 is attached to reinforcement 22, a pocket 49 is formed between ceiling 46 and the outside of sheath 12 to permit hand 24 of the operator when inserted through opening 14 to engage top portion 36 and bottom portion 38 of reinforcement portion 22. When top portion 36 and bottom portion 38 engage sheath 12, accordion portion 42 is positioned adjacent sealed end 16 to form a C-shaped reinforcement portion 22.

Figure 2:
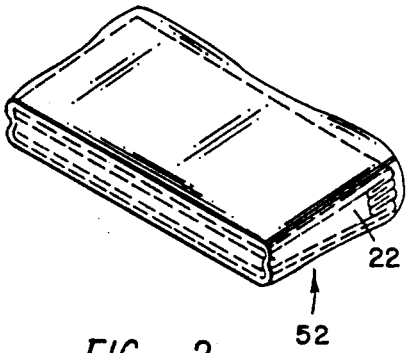
FIG. 2 is a perspective view of an alternate embodiment of the waste disposal apparatus where the sheath is extended to preferably cover only the hand of the operator of the device.

Referring to FIG. 2, an alternate embodiment of the apparatus designated generally by number 52 is shown. This embodiment is substantially identical to the apparatus 10 in FIG. 1 with the exception that sheath 12 extends only the width of top portion 36 and bottom portion 38.

Figure 4:
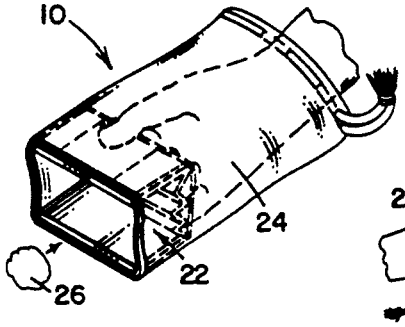
FIGS. 4–6 are perspective views of various stages of the waste disposal apparatus when collecting an object according to the present invention.
Figure 5:
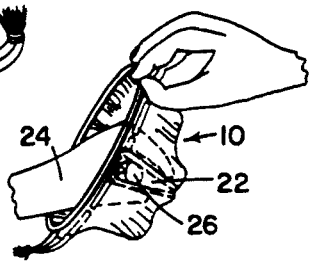
Figure 6:
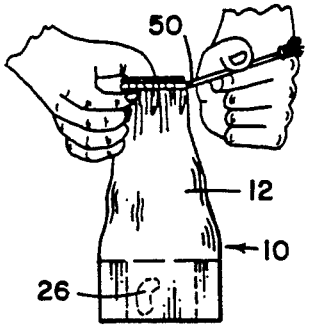

Referring to FIGS. 4–6, there is shown an exemplary method of picking up an object 26. In this method, the user places a hand 24 into the open end 14 of sheath 12. The hand is slid forward to insert the fingers into the pocket 49 adjacent top portion 36 and bottom portion 38. The fingers then engage the reinforcement portion 22 and are manipulated to slide bottom portion 38 below object 26 and place object 26 in a second receiving portion 21 created by reinforcement portion 22. Once the object is received, top and bottom portions 36 and 38 collapse to allow the reinforcement portion 22 to hold object 26. Reinforcement 22 is then collapsed and drawn through open end 14, while sheath 12 is folded about fold line 18 inside out.

A string 50 circumscribingly attaches to sheath 12 adjacent opening 14. Although string 50 is shown weavingly attached to sheath 12, the string may be attached by other methods such as heat sealing or glue. String 50 may be pulled to collapse open end 14 and seal open end 14.

The apparatus can be used in an extremely hygienic manner. The object to be picked up must not be touched by the user with his hands. After having used the apparatus, all waste is hygienically sealed. Accordion portion 42 prevents objects 26 from causing perforations in sheath 12.

As already mentioned, the apparatus is suitable for picking up the feces or excrement of dogs. However, it may also be used in other fields, such as for instance hospitals and laboratories just to mention a few possibilities.

A reading by those skilled in the art will bring to mind various changes without departing from the spirit and scope of the invention. It is intended, however, that the invention only be limited by the following appended claims.

What is claimed is:

1. A method for assembly of an apparatus, and for picking up and removing objects, such as animal excrement, the method comprising the steps of:

providing a sheath having an opening at one end and being sealed at its other end;

circumferentially subscribing on the sheath a fold line adjacent the sealed end;

folding back the sealed end into the sheath about the fold line to form a first receiving portion having a ceiling and a floor;

providing a reinforcement device having a top portion, an oppositely facing bottom portion and an accordion portion extending substantially perpendicularly between said top portion and said bottom portion;

placing the reinforcement device within the first receiving portion;

attaching a portion of said top portion to the ceiling and a portion of said bottom portion to said floor;

positioning the accordion portion adjacent the sealed end when the top and bottom portions are attached to form a second receiving portion with the reinforcement device;

placing a hand into the open end of the sheath to engage the top and bottom portions of the reinforcement device;

manipulating the engaged top and bottom portions to pick up the object and place the object into the second receiving portion; and using the accordion portion to prevent the object placed in the second receiving portion from contacting said sealed end of the sheath.

2. The method as recited in claim 1 further comprising the step of inwardly folding the second receiving portion about the fold line and through said opening after placing the object into the second receiving portion.

3. The method as recited in claim 2 further comprising the steps of:

attaching a string generally circumscribing said sheath adjacent the open end; and sealing the sheath with the string after inwardly folding the second receiving portion.

4. The method as recited in claim 1 further comprising the steps of:

constructing the reinforcement device by:

(a) providing a generally rectangular sheet constructed with relatively stiff material;

(b) scoring said rectangular sheet with a plurality of parallel lines extending from one side of the sheet to the other side about a mid portion of the sheet;

(c) folding the sheet in the same direction on alternate scored parallel lines and in opposite directions on adjacent scored parallel lines to form the accordion portion; and (d) collapsing the accordion portion to position the top portion in a plane in close proximity to and substantially parallel to a plane of the bottom portion.

5. The method as recited in claim 1 further comprising the step of heat sealing the top portion and bottom portion to the reinforcement device.

6. An apparatus for picking up and removing objects comprising:

a generally C-shaped reinforcement device constructed from a substantially stiff material portion and having a top portion, bottom portion and a flexible portion extending generally perpendicularly therebetween, said reinforcement device having an opening in which objects can be received; and a sheath surrounding the device and having an open end through which a hand of an operator of the apparatus can be inserted to engage the reinforcement device, said sheath being attached to said reinforcement device to create a pocket between said sheath and said top portion and between said sheath and said bottom portion such that when said hand is inserted to engage the reinforcement device, fingers of the operator can be inserted into the pockets; and said flexible portion being collapsible sufficient to permit the distance between the top portion and bottom portion to be adjusted to conform to the distance between the thumb and forefingers on the hand of the operator when inserted into the pockets to permit the apparatus to be manipulated to pick up the objects.

7. The apparatus as recited in claim 6 wherein said sheath has a sealed end adjacent said flexible portion on the other end of said sheath from said open end, said sealed and being folded into said sheath to form a receiving portion and said C-shaped reinforcement device being positioned in said receiving portion, with said opening facing away from said sheath.

8. The apparatus as recited in claim 7 wherein said flexible portion further comprises means for permitting said reinforcement device to collapse so that said reinforcement device can be drawn through said open end to enclose picked up objects within said sheath.

9. The apparatus as recited in claim 6 further comprising a string attached to sheath and generally interweavingly circumscribing said sheath adjacent the open end, said string operative to collapse and seal open end when pulled.

10. The apparatus as recited in claim 6 wherein said sheath is sealed to said top and bottom portion to form a pocket.

11. An apparatus for picking up and removing one or more objects, such as animal excrement, the apparatus comprising;

a reinforcement device constructed from a substantially stiff material, said material being flat and having a top end, bottom end, left end and right end, a top portion adjacent the top end and a bottom portion adjacent a bottom end, said device having a plurality of parallel score lines extending from the left end to the right end between said top and bottom portions, said adjacent parallel score lines being folded in opposite directions to form an accordion portion extending substantially perpendicular between said top and bottom portions;

a sheath having an open and a sealed end;

a fold line circumscribing said sheath adjacent said sealed end;

said sheath sealed end being folded along said fold line and into said sheath to form a first receiving portion having a ceiling and a floor;

a portion of said top portion being attached to said ceiling and a portion of said bottom portion being attached to said floor to form a pocket in said sheath in which fingers on a hand of an operator can be inserted; and said accordion portion being disposed adjacent said sealed end such that said fingers of the operator can be inserted through said open end and into said pocket to engage the reinforcement device to manipulate the apparatus to pick up the objects, and said accordion portion being positioned between the object and said sealed end to prevent the object from engaging with the hand of the operator.

12. The apparatus as recited in claim 11 wherein said accordion portion expands and contracts said reinforcement device to permit said top and bottom portions to collapse to engage the objects during pick up.

13. The apparatus as recited in claim 12 wherein said accordion portion collapses sufficient to permit said reinforcement device to be inserted through said open end when said objects are engaged to contain the objects within the sheath.

14. The apparatus as recited in claim 13 further comprising means including a string for sealing the open end of said sheath when the objects are contained within the sheath.

15. The apparatus as recited in claim 11 wherein said reinforcement device is generally rectangularly shaped.

* * * * *